US009693441B2

(12) United States Patent
Patelli et al.

(10) Patent No.: US 9,693,441 B2
(45) Date of Patent: Jun. 27, 2017

(54) METHOD FOR GENERATING AN ATMOSPHERIC PLASMA JET AND ATMOSPHERIC PLASMA MINITORCH DEVICE

(71) Applicant: NADIR S.R.L., Padua (IT)

(72) Inventors: Alessandro Patelli, Padua (IT); Emanuele Verga Falzacappa, San Vendemiano (IT); Paolo Scopece, Spinea (IT); Roberto Pierobon, Vigonza (IT); Simone Vezzu', Padua (IT)

(73) Assignee: NADIR S.R.L., Padua (IT)

( * ) Notice: Subject to any disclaimer, the term of this patent is extended or adjusted under 35 U.S.C. 154(b) by 0 days.

(21) Appl. No.: 15/035,759

(22) PCT Filed: Nov. 14, 2014

(86) PCT No.: PCT/IB2014/002459
§ 371 (c)(1),
(2) Date: May 11, 2016

(87) PCT Pub. No.: WO2015/071746
PCT Pub. Date: May 21, 2015

(65) Prior Publication Data

US 2016/0295676 A1 Oct. 6, 2016

(30) Foreign Application Priority Data

Nov. 14, 2013 (IT) ..... PD2013A0310

(51) Int. Cl.
*H05H 1/30* (2006.01)
*H05H 1/24* (2006.01)

(52) U.S. Cl.
CPC ..... *H05H 1/30* (2013.01); *H05H 1/2406* (2013.01); *H05H 2001/2462* (2013.01); *H05H 2245/125* (2013.01)

(58) Field of Classification Search
CPC ..... H05H 1/30; H05H 1/2406; H05H 1/46; H05H 2001/2462; H05H 2245/125; H01J 37/32091; H01J 37/32165
See application file for complete search history.

(56) References Cited

U.S. PATENT DOCUMENTS 5,198,724 A 3/1993 Koinuma et al.
5,414,324 A 5/1995 Roth et al.
(Continued)

FOREIGN PATENT DOCUMENTS

EP 1096837 A2 5/2001
EP 1844635 B1 6/2006
(Continued)

*Primary Examiner* — Don Le
(74) *Attorney, Agent, or Firm* — Mark M. Friedman

(57) ABSTRACT

A method and a device for generating a plasma in atmospheric-pressure, low-temperature conditions are described herein. The device described for the generation of the plasma comprises a first pair of electrodes, each of which separated by a dielectric layer and externally positioned with respect to a tubular duct where the gas flows, and a second pair of electrodes, also in this case each of which separated by a dielectric layer and externally positioned with respect to said tubular duct where the same gas flows downstream with respect to the first pair with respect to the direction of the flow. A high-frequency excitation is applied to the first pair of electrodes while a Radio-Frequency excitation is applied to the second pair of electrodes. The plasma generated in this manner emerges from the gas flow at the outlet of the transport duct. The high-frequency excitation can be applied in pulse trains and the Radio-Frequency generator is substantially activated in said pulse trains for the purpose of
(Continued)

limiting the thermal load on the treated substrate. Chemical precursors and reagents can be added to the plasma as vapors or aerosols by means of a central transport duct coaxial with the tubular duct for the gas.

17 Claims, 5 Drawing Sheets

(56) References Cited

U.S. PATENT DOCUMENTS

| | | | | |
|---|---|---|---|---|
| 6,265,690 | B1 | 7/2001 | Fornsel et al. | |
| 6,465,964 | B1 | 10/2002 | Taguchi et al. | |
| 6,676,802 | B2 | 1/2004 | Roth | |
| 6,800,336 | B1 | 10/2004 | Fornsel et al. | |
| 6,943,316 | B2 | 9/2005 | Konavko et al. | |
| 6,958,063 | B1 * | 10/2005 | Soll | A61B 18/042 606/32 |
| 8,267,884 | B1 | 9/2012 | Hicks | |
| 2004/0012319 | A1 | 1/2004 | Shun'ko | |
| 2006/0015698 | A1 | 1/2006 | Kim et al. | |
| 2007/0272358 | A1 * | 11/2007 | Iseda | H01J 37/32091 156/345.28 |
| 2008/0220175 | A1 * | 9/2008 | Mangolini | B01J 19/088 427/430.1 |
| 2011/0298376 | A1 * | 12/2011 | Kanegae | B01J 19/088 315/111.51 |
| 2015/0126037 | A1 * | 5/2015 | Chen | H01J 37/32091 438/711 |

FOREIGN PATENT DOCUMENTS

| | | | |
|---|---|---|---|
| EP | 2312612 | A2 | 4/2011 |
| WO | 02/13222 | A1 | 2/2002 |
| WO | 2008/074604 | A1 | 6/2008 |

* cited by examiner

METHOD FOR GENERATING AN ATMOSPHERIC PLASMA JET AND ATMOSPHERIC PLASMA MINITORCH DEVICE

FIELD OF APPLICATION

The invention regards the methods and devices for generating a plasma. In particular, the present invention relates to an innovative method for generating an atmospheric plasma with low power and low temperature, the design of a device that can be manually used and its use for treating surfaces and for the deposition of surface coatings by means of the introduction of a precursor in a channel situated inside and coaxial with respect to the duct with the plasma.

STATE OF THE ART

In the scope of the technologies relative to atmospheric plasmas, numerous solutions have been developed for various purposes ranging from high-power surface treatments to low-power, low-temperature applications. In the first case, the sources that operate at atmospheric pressure are based on arc discharges and produce so-called thermal plasmas with temperatures well above several thousand degrees Kelvin. In order to obtain cold atmospheric plasmas, however, the transition towards arc discharges must be avoided, and consequently briefer power pulses must be used in the generation of the plasma. In recent years, various sources with different power generators and geometries have been developed, leading to the birth of various original designs such as those described in the articles C. Tendero, C. Tixier, P. Tristant, J. Desmaison and P. Leprince; SpectrochimicaActa Part B 61 (2006) 2-30; X. Lu, M. Laroussi and V. Puech: Plasma Sources Sci. Technol. 21 (2012) 034005 (17 pp); G. Y. Park et al.: Plasma Sources Sci. Technol. 21 (2012) 043001. The sources of atmospheric plasma can be classified on the basis of their excitation mechanism, into three main groups: the DC (direct current) plasmas with low frequency, the plasmas struck at Radio Frequency and the plasmas struck by microwave generators.

The trend towards the miniaturization of these plasma systems is important for the purpose of creating portable systems with lower power capable of reducing instrumentation and running costs. A brief general presentation of these systems can be found, for example, in the article by S. D. Anghel, A. Simon, A. I. Radu, and I. J. Hidi; Nucl. Instr. Meth. Phys. Res. B 267 (2009) 430-433. In the literature, numerous types of atmospheric plasmas with low and very low power can be found for biomedical, environmental and technological applications. The most important of these are the following: plasma needle, plasma pencil, miniature pulsed glow-discharge torch, open-air hollow slot microplasm, and atmospheric pressure plasma (micro)jet. Different types of plasma jet have application for the modification of surfaces, deposition of thin films, sterilization or surface modification of polymer fibers as is described for example in the article by S. D. Anghel et al.

All of these different models and technologies for plasma jets have the object of finding the best compromise for increasing the number of reactive species in the gas in proximity to the surface, without inducing heating.

U.S. Pat. No. 5,198,724 by Koinuma et al. describes a plasma source constituted by metal and concentric electrodes power supplied by a high-frequency generator. In this device, the plasma is in direct contact with the metal electrode and can involve the emission of metal particles due to surface microfusions, thus contaminating the treated substrate. If a radio-frequency generator is used, the overheating of the central electrode is nonetheless observed, and high voltages or limited size are necessary for striking plasmas in the presence of gases containing oxygen.

The patents WO 2008/074604, U.S. Pat. No. 6,265,690 and U.S. Pat. No. 6,800,336 by Fornsel et al. (Plasma Treat) describe a device operating at high frequency of arc type, bearing current with a vortical inflow of the gas flow into the channel of the nozzle. The plasma jet is very stable with low erosion of the cathode but with temperatures of the gas typically on the order of hundreds of degrees Celsius.

U.S. Pat. No. 6,943,316 describes a system for generating a chemically active jet (active gas jet) by means of a plasma generated by an electric discharge in a process gas. This invention concentrates the attention on the design of the nozzle. The authors describe in exhaustive detail the possibility of increasing the exit velocity of the gas by modifying the geometry of the nozzle and in particular by using converging/diverging nozzles. Nevertheless, in this invention, the plasma is generated by a conventional electric discharge obtained by a single pair of electrodes operating at high frequency or at radio frequency. The disadvantage of this solution is the overheating of the central electrode and its erosion due to the formation of arcs, with consequent deposition of metal material on the surface to be treated.

Kogelschatz et al. "Filamentary patterned and diffuse barrier discharge" in Kogelschatz et al. IEEE transactions on Plasma Science, vol. 30 page 1400 (2002) and U.S. Pat. Nos. 5,414,324 and 6,676,802 by Roth et al. describe the generation and use of atmospheric plasmas of Dielectric Barrier Discharge (DBDs) type. One of the disadvantages of the current DBDs is that the density of reactive species is relatively low. Hence, in order to obtain surface treatments in industrially-acceptable times and modes, it is necessary to position the object to the treated between the two electrodes within the discharge, consequently limiting the type and geometry of the objects to be treated.

U.S. Pat. No. 6,465,964 by Taguchi et al. describes a system that can generate an atmospheric plasma, with good reliability, by means of the use of a support electrode for turning on the device (striking of the plasma) without having to use a costly system for the impedance adaption. This device comprises a chamber for the generation of the plasma with an opening from which the plasma flows out, a process gas, a single pair of electrodes, an alternating current generator and a pulse generator for the generation of the plasma. The two different generators must be alternately used in this device, one for striking the discharge and a second for sustaining the plasma.

US Patent No. US2006/0156983 by Penelon et al. describes a system and relative device for the radio-frequency generation of a plasma, where the electrodes are facing and placed outside a tube made of dielectric material. In this configuration, a central electrode is not present while the electrodes are separated by a double dielectric barrier. In this system, it is necessary to obtain high RF voltages for allowing the striking, particularly in atmospheres with the presence of oxygen. For this reason, the spacing between the electrodes must be limited. In order to increase the size of the plasma region, other solutions are considered and presented, for example in U.S. Pat. No. 8,267,884 by Hicks and in U.S. Pat. No. 8,328,982 by Babayan. The source includes a device for deposition by means of the addition of a precursor flow at the outlet of the plasma after the earth electrode.

European Patent EP 1,844,635 by Rego et al. describes a system for generating a plasma by means of a configuration that provides for a central electrode and a DBD coaxial system. The particular positioning and design of the insulator in the counter-electrode allows this device to prevent the formation of electric arcs and the consequent contamination of the material to be treated.

Reported more recently is the beneficial effect of using a plasma with a double frequency in numerous atmospheric plasma devices. For example, in "A cold atmospheric pressure plasma jet controlled with spatially separated dual-frequency excitations" by Z. Cao et al. (described in Z. Cao J. Phys. D: Appl Phys 42 (2009) 222003), a device constituted by a quartz tube with a central electrode polarized at 5.5 MHz is combined with a second excitation at 30 Khz spatially separated from the first. The counter-electrode is represented by a plate positioned at the outlet of the gas in the typical position of a substrate to be treated. In this device, the combination with a non-pulsed AC excitation is aimed for increasing the efficiency of extraction of the plasma while maintaining a low gas temperature. Nevertheless, this system has a central electrode along with a counter-electrode plate which represent a big limitation from the standpoint of bulk and versatility in using this device type. The use of a device with double frequency is also reported in "Characteristics of kilohertz-ignited, radio-frequency atmospheric-pressure dielectric barrier discharges in argon" by Pei-Si Le et al. (described in Pei-Si Le et al., Appl Phys Lett 95 (2009) 201501). In this device, two pairs of electrodes are used in DBD configuration; nevertheless, the non-pulsed excitation in kilohertz frequency conditions is exclusively limited to the striking of the plasma in a first step of generating the plasma, and is then deactivated as soon as the plasma is struck and then sustained by means of a RF generator. In addition, the double frequency is also reported in "Study of a dual frequency atmospheric pressure corona plasma" by Dan Bee Kim et al. (described in Dan Bee Kim et al., Physics of Plasmas 17 (2010) 053508. In this publication, a device is considered that is constituted by a Pyrex glass tube with a central electrode made of copper. The two frequencies are respectively 2 and 13.56 MHz, both non-pulsed and used simultaneously. Several beneficial effects are reported in terms of current density and length of the plasma plume.

In the presented literature, it is possible to observe that in the atmospheric plasma torch devices, most of the configurations have a central electrode which prevents depositing in inflow conditions of the precursor that is coaxial with respect to the transport gas flow; the precursor in these cases is generally added at the outlet of the plasma, and the overheating and the erosion of the central electrode can lead to the emission of the material of the electrode at the torch outlet. Moreover, the configurations without central electrode or with a dielectric screen on both electrodes require high discharge voltages, particularly in atmospheres containing oxygen. Consequently, the striking and support of the RF discharge, capable of offering high plasma density while maintaining a low gas temperature, is difficult, requires limiting spacing between the electrodes and hence very limited useful plasma regions. This problem can be overcome by adding a high-voltage striking device, which is then immediately turned off, leaving the support of the discharge at radio frequency. Finally, a further problem of the RF discharges is represented by the poor capacity of extraction of the plasma outside the region of the electrodes, which in some cases requires the use of a central electrode that provides a strong axial component to the electric field, or the use of further electrodes for extraction outside the torch.

The patent US 2011/298376 describes an atmospheric plasma device, which comprises a tubular duct made of dielectric material with an inlet section fed with a process gas constituted by a pure noble gas such as argon or helium, and an outlet section from which a plasma plume is emitted for executing processing on very wide surfaces.

In addition, the device comprises a pair of electrodes associated with the tubular duct and connected with a generator at frequency between 50 Hz and 300 kHz, which can be driven for generating a first plasma within the tubular duct itself.

The device also comprises a coil wound around the tubular duct, placed downstream of the pair of electrodes with respect to the flow direction of the process gas, and connected to a Radio-Frequency generator susceptible of generating, by means of such coil, a second plasma ICP (inductive coupled plasma) at high temperature.

In addition, in order to obtain said plasma ICP with mixtures of gases, the device necessarily comprises an auxiliary duct connected to the tubular duct downstream of the first pair of electrodes and at the coil, and adapted to introduce, into the tubular duct, one or more reactive or transport gases (such as hydrogen, nitrogen, oxygen, air, etc.) as a function of the particular processing for which the device is used. The device does not allow the introduction of the reactive or transport gases (such as hydrogen, nitrogen, oxygen, air, etc.) upstream of the first pair of electrodes, since for striking the first pair a further strike device would be necessary.

In particular, the generator connected to the pair of electrodes of the device is driven during an initial step of striking the second plasma ICP and it is then turned off, therefore interrupting the generation of the first plasma, since the ICP plasma, once struck, is self-sustaining.

A first drawback of the device described in the patent US 2011/298376 is due to the fact that it absolutely cannot be used for processing at low temperature, since the radio-frequency generator generates, by means of the coil, ICP plasma at a temperature of the neutral gas at the outlet of the device not less than several hundred degrees Kelvin.

A further drawback of the device described in the patent US 2011/298376 is due to the fact that it requires one or more auxiliary ducts for the reactive or transport gases functional for the different processing for which the device can be used, with a consequent increase of the production costs of the device itself.

PRESENTATION OF THE INVENTION

In order to overcome the limitations reported by the state of the art described above, several configurations of the present invention are aimed to develop a technique and device for generating a plasma in atmospheric pressure conditions, with different gases and mixtures, and temperatures of the gas at the outlet not higher than 100° C.

As is known to the man skilled in the art, a plasma is defined as a partially or completely ionized gas that comprises free electrons, ions, radicals and atoms or molecules of non-ionized neutral gas. In weakly-ionized plasmas as in the case of the present device and method of generation, the macroscopic temperature can be substantially compared to the temperature of the neutral gas.

In the present invention, a method is described for producing an atmospheric plasma jet that comprises the following parts: flowing a process gas that advances in a flow direction through a tubular duct (FIG. 2 201, FIG. 4 401, FIG. 6 601) made of dielectric material with an inlet section and an outlet section at atmospheric pressure; positioning a first pair of coaxial electrodes (FIG. 2 203-204, FIG. 3 307-308, FIG. 4 404-405, FIG. 6 603-604) and a second pair of coaxial electrodes (FIG. 2 205-206, FIG. 3 309-310, FIG. 4 406-407, FIG. 6 605-606) in contact with the external surface of said tubular duct (FIG. 2 201, FIG. 4 401, FIG. 6 601); said first pair of electrodes (FIG. 2 203-204, FIG. 3 307-308, FIG. 4 404-405, FIG. 6 603-604) being placed in position upstream of said second pair of electrodes (FIG. 2 205-206, FIG. 3 309-310, FIG. 4 406-407, FIG. 6 605-606) in relation to the flow direction of the gas within said tubular duct (FIG. 2 202, FIG. 4 402, FIG. 6 602) and being connected to a high-frequency generator (FIG. 2 208, FIG. 3 301); said second pair of electrodes (FIG. 2 205-206, FIG. 3 309-310, FIG. 4 406-407, FIG. 6 605-606) being connected to a Radio-Frequency generator (FIG. 2 209, FIG. 3 303); said high-frequency generator (FIG. 2 208, FIG. 3 301) generating a filamentary plasma within said tubular duct (FIG. 2 203-204, FIG. 3 307-308, FIG. 4 404-405, FIG. 6 603-604), said filamentary plasma extending at least to said second pair of electrodes (FIG. 2 205-206, FIG. 3 309-310, FIG. 4 406-407, FIG. 6 605-606); said Radio-Frequency generator (FIG. 2 209, FIG. 3 303) generating a second RF plasma; flowing out said RF plasma and said filamentary plasma to outside of the tubular duct through the outlet section (FIG. 2 207, FIG. 4 410), such plasmas at the outlet comprising at least one neutral gas at the outlet having temperature not higher than about 100° C.

In addition, in the present invention, a device is described for producing an atmospheric plasma jet that comprises the following parts: said tubular duct (FIG. 2 201, FIG. 4 401, FIG. 6 601) made of dielectric material with an inlet section and an outlet section at atmospheric pressure; said first pair of coaxial electrodes (FIG. 2 203-204, FIG. 3 307-308, FIG. 4 404-405, FIG. 6 603-604) and said second pair of coaxial electrodes (FIG. 2 205-206, FIG. 3 309-310, FIG. 4 406-407, FIG. 6 605-606) in contact with the external surface of said tubular duct (FIG. 2 201, FIG. 4 401, FIG. 6 601); said first pair of electrodes (FIG. 2 203-204, FIG. 3 307-308, FIG. 4 404-405, FIG. 6 603-604) being placed in position upstream of said second pair of electrodes (FIG. 2 205-206, FIG. 3 309-310, FIG. 4 406-407, FIG. 6 605-606) in relation to the flow direction of the gas within said tubular duct (FIG. 2 202, FIG. 4 402, FIG. 6 602) and being connected to a high-frequency generator (FIG. 2 208, FIG. 3 301); said second pair of electrodes (FIG. 2 205-206, FIG. 3 309-310, FIG. 4 406-407, FIG. 6 605-606) being connected to said Radio-Frequency generator being arranged for generating a filamentary plasma within said tubular duct (FIG. 2 203-204, FIG. 3 307-308, FIG. 4 404-405, FIG. 6 603-604), said filamentary plasma extending at least to said second pair of electrodes (205-206, 309-310, 406-407, 505-506) and exiting from said tubular duct (FIG. 2 201, FIG. 4 401, FIG. 6 601) through said outlet section; said Radio-Frequency generator (FIG. 2 209, FIG. 3 303) being arranged for generating a RF plasma which exits from said tubular duct (FIG. 2 201, FIG. 4 401, FIG. 6 601) through said outlet section; the plasmas exiting from the outlet section of said tubular duct (FIG. 2 201, FIG. 4 401, FIG. 6 601) comprising at least one neutral gas at the outlet having temperature not higher than about 100° C.

In the present invention, the high-frequency generator comprises the function of generating the filamentary plasma which provides charged species that facilitate the striking and the support of the RF plasma with supply voltages that are reduced with respect to those necessary without the high-voltage generator, allowing the striking and sustenance of the RF plasma in the presence of noble gases but also with mixtures thereof with molecular gases.

As is known to the man skilled in the art, a filamentary plasma is obtained when, in a gas, an electric field is applied that is greater than the strike voltage and hence such to accelerate the electrons and cause an avalanche ionization along the direction of the electric field itself. The electrons leave a column of positive charge behind them and for strong electric fields that come to be formed, comparable to the applied field itself, the avalanche is self-propagated, forming a filament that then dies out. The filaments that are formed are transient.

In the present invention, the high-frequency generator comprises the function of generating an electric field such to increase the light intensity of the RF plasma by at least 20% at the distance of 3 mm from the outlet section of the device.

In the present invention, the radio-frequency generator comprises the function of generating the RF plasma and, by means of controlling the power applied by the radio-frequency generator, the function of controlling the plasma density at the outlet section of the device.

Advantageously, according to the method, object of the present invention, during the generation of the second RF plasma, by the Radio-Frequency generator (209, 303), the high-frequency generator (208, 301) is substantially always operative for generating the aforesaid filamentary plasma.

More in detail, preferably, the high-frequency generator (208, 301) is always maintained operative during the operation of the Radio-Frequency generator (209, 303), providing charged species that ensure the sustenance and the extraction of the RF plasma even in the presence of process gases comprising mixtures of one or more noble gases with one or more reactive or transport gases.

In the present invention, the plasma generation method can be pulsed by means of the use of the high-frequency generator of pulse trains and with the radio-frequency generator substantially active in said pulse trains in order to be able to control the thermal load on the treated substrate.

In the present invention, the atmospheric plasma device comprises control means connected to the high-frequency generator (208, 301) and to the Radio-Frequency generator (209, 303) and arranged for controlling the high-frequency generator (208, 301) between a first non-operative state, in which the high-frequency generator (208, 301) is substantially turned off, without generating the filamentary plasma, and a first operative state, in which the high-frequency generator (208, 301) generates the filamentary plasma. In addition, the control means are arranged for controlling the radio-Frequency generator (209, 303) between a second non-operative state, in which the radio-Frequency generator (209, 303) is turned off, without generating the RF plasma, and a second operative state, in which the high-frequency generator (209, 303) generates the RF plasma with the high-frequency generator (208, 301) in the aforesaid first operative state.

More in detail, preferably, when the radio-Frequency generator (209, 303) is controlled in its second operative state, the high-frequency generator (208, 301) is controlled in its first operative state, providing the charged species for the sustenance and extraction of the RF plasma.

Preferably, the aforesaid control means comprise an electronic control unit connected to said high-frequency generator (FIG. 2 208, FIG. 3 301) and to said radio-frequency generator (FIG. 2 209, FIG. 3 303), and programmed for controlling the activation of said radio-frequency generator (controlled in its second operative state) during pulse trains generated by the high-frequency generator (controlled in its first operative state).

In the present invention, the device can be termed plasma minitorch and comprises a portable manual device (typically termed torch or pen) aimed for producing a plasma jet at atmospheric pressure with low power and low temperature (LPLT-APPJ).

In the present invention, the mini-plasma torch comprises said dielectric tubular duct (FIG. 2 201, FIG. 4 401, FIG. 6 601) in which the gas flow flows and within which the plasma is generated. The device is also equipped with two said pairs of coaxial electrodes; said first pair of coaxial electrodes (FIG. 2 203-204, FIG. 3 307-308, FIG. 4 404-405, FIG. 6 603-604) and said second pair of coaxial electrodes (FIG. 2 205-206, FIG. 3 309-310, FIG. 4 406-407, FIG. 6 605-606) in contact with the external surface of said tubular duct (FIG. 2 201, FIG. 4 401, FIG. 6 601), generating the plasma in Dielectric Barrier Discharge (DBD) mode and also maintaining the volume, comprised between the electrodes, of gas flow and plasma generation free from metallic electrodes in contact with the plasma and from electrodes positioned along the axis or symmetry plane of the dielectric tubular duct.

In the present invention, the transport gas can be a monatomic noble gas (He, Ar, Ne, Kr) or a mixture thereof or a molecular gas (nitrogen, oxygen, carbon dioxide, hydrocarbons, etc.) or mixtures of these or a mixture of one or more monatomic gases with one or more molecular gases.

Advantageously, in accordance with the method, object of the present invention, the process gas, introduced into said tubular duct (201, 401, 501) through the inlet section thereof, comprises a mixture containing at least one noble gas, selected in particular from among He, Ar, Ne, Kr, and at least one reactive gas selected in particular from among nitrogen, oxygen, carbon dioxide, hydrocarbons, sulfur hexafluoride, fluorocarbons, ammonia, etc.

Advantageously, the minitorch device, object of the present invention, comprises at least one supply source connected to the inlet section of said tubular duct (201, 401, 501) and arranged for introducing, into said tubular duct (201, 401, 501), said process gas in the form of the aforesaid gas mixture.

In particular, the supply of the process gas in mixture form directly into the inlet section of the tubular duct (201, 401, 501), which can be modulated both with regard to composition and flow, with the high-frequency generator (208, 301) which is always maintained active during the operation of the Radio-Frequency generator (209, 303), allows generating the RF plasma adapted for the specific processing to be actuated without having to employ separate supply ducts for the reactive and transport gases, since as stated above the high-frequency generator (208, 301) maintained always operative provides the charged species that ensure the sustenance and extraction of the RF plasma even in the presence of mixtures (and hence with process gas not exclusively constituted by a noble gas).

The two said pairs of coaxial electrodes (FIG. 2 203-204, FIG. 3 307-308, FIG. 4 404-405, FIG. 6 603-604) and (FIG. 2 205-206, FIG. 3 309-310, FIG. 4 406-407, FIG. 6 605-606) are made of electrically conductive material such as metal materials or conductive ceramics. In the present invention, a specific impedance adaptation circuit performs the function of adapting the impedance of the generator and the load necessary for ensuring an effective transmission of the radio-frequency power from the generator to said minitorch; said circuit can be externally placed with respect to the device or directly integrated within the Radio-Frequency generator, or within the body of the minitorch and correctly set as a function of the inlet conditions of the gas and the requested application spectrum.

One example of the present invention comprises a device in which the two said pairs of electrodes are arranged outside said tubular duct; in which the two said pairs of electrodes respectively operate in high frequency (1-100 KHz) and Radio Frequency (1-30 MHz) conditions; in which said impedance adaptation circuit of the power is obtained by means of a specific dedicated circuit; in which the two different power supplies to the respective electrodes are insulated from each other and only electrically coupled by the plasma generated within the tubular duct and with the radio-frequency generator active only simultaneously with the high-frequency generator.

One example of the present invention comprises the possibility of generating, with the high-frequency generator (FIG. 2 208, FIG. 3 301), pulse trains with pulse duration up to 20 ms and with a duty cycle comprised in the range of 1 to 98%; and where the front of the signal at high frequency is combined with the signal at Radio Frequency or vice versa in order to have both generators operating in a synchronized manner, with the radio-frequency generator thus active only during said pulse train.

In one example of the present invention, as illustrated in FIG. 2, the two said pairs of electrodes (FIG. 2 203-204-205-206) are arranged external and coaxial with respect to said tubular duct (FIG. 2 201), said second pair of electrodes (FIG. 2 205-206) is positioned downstream with respect to said first pair of electrodes (FIG. 2 203-204) in relation to the flow of the gas into said tubular duct (FIG. 2 202); each pair consists of 2 annular electrodes that face each other; in this example, in the first pair of said electrodes, the electrode 1 (FIG. 2 203) is polarized at high frequency (28 KHz) (FIG. 2 208) with a pulse of 2 ms and a useful work cycle of 80%, the electrode 2 (FIG. 2 204) is grounded, and in said second pair of electrodes the electrode 3 (FIG. 2 205) is polarized at Radio Frequency (13.56 MHz) (FIG. 2 209) in a simultaneous and synchronized manner with the pulse trains generated at high frequency and connected with an impedance adaptation circuit (FIG. 2 210), the electrode 4 is grounded (FIG. 2 206); wherein the distance between the two pairs of electrodes can be regulated by moving them along said dielectric tubular duct and wherein the electric power supply circuits of the first pair of electrodes and of the second pair of electrodes are electrically insulated and the two said pairs of electrodes electrically communicate with each other through the plasma generated within said tubular duct.

The material of said dielectric tubular duct (FIG. 2 201) can be quartz, glass, ceramic such as aluminum oxide, zirconium oxide, polymer with high dielectric rigidity; the internal diameter of the tubular duct (FIG. 2 201) can be comprised between 1 and 15 mm while the thickness of the tubular duct (FIG. 2 201) can be as thin as possible, varying between 0.1 and 1.0 mm;

The coupling of a high-frequency power supply with a radio-frequency power supply and specifically the possibility to operate with pulse trains is designed in order to obtain a cold and self-sustained plasma in a wide range of work conditions and mixtures and also in the presence of precursors for depositing coatings and functionalizations; air, helium, hydrogen, neon, nitrogen, argon, oxygen or mixtures thereof can be used as transport gas in any ratio, allowing the obtainment of a wide array of chemically active species in the plasma; percentages of oxygen comprised between 0.01% and 100% can be used, as can percentage of hydrogen comprised between 0% and 20%;

The plasma jet generated by the device described in the present invention is capable of striking and sustaining a plasma in conditions of power higher than 30 W, outlet section of 0.5 $cm^2$ and with temperatures lower than 40° C. due to the power supply by means of the combined use of said high-frequency generator and the radio-frequency generator and by means of the synchronization of high-frequency pulse trains (FIG. 2 208, FIG. 3 301) with a Radio-Frequency generator (FIG. 2 209, FIG. 3 303)

Another example of the present invention allows flowing organic or metalorganic chemical precursors such as siloxanes, silazanes, transition metal alkoxides such as titanium isopropoxide, titanium tert-butoxide, zirconium isopropoxide and tert-butoxide, aluminum tert-butoxide, transition metal acetylacetonates such as titanium acetylacetonate, glycols like ethylene glycol, organic acids such as acrylic acid, methacrylic acid, acetic acid, organic acrylates, hydrocarbons or polyolefins, alcohols, suspensions of nanoparticles dispersed in water or solvents where the nanoparticles can be metal oxides such as silicon oxides, titanium oxides, zirconium oxides, aluminum oxide, cerium oxide, chromium oxide or pure metals such as titanium, zirconium, silver, copper, gold, platinum, palladium, rare-earth metals or other transition metals. The abovementioned chemical precursors flow within a transport duct (FIG. 4 409) positioned inside and coaxial with respect to a separation duct (FIG. 4 408) made of insulating material, in turn placed inside and coaxial with respect to said tubular duct (FIG. 4 401), both said ducts, transport and separation, with the free emission end placed within said tubular duct in coinciding or retreated position with respect to the outlet section of said tubular duct; wherein if a liquid precursor or a precursor in the suspension form is flowed into the transport duct (FIG. 4 409), the formation of an aerosol is verified at the outlet of the transport duct due to the contact with a nebulizer gas that flows into the annular cavity comprised between the external surface of the transport duct and the internal surface of the separation duct (FIG. 4 408); wherein the transport duct (FIG. 4 409), the separation duct (FIG. 4 408) and the tubular duct (FIG. 4 401) are completely independent from each other and wherein the relative position between the transport duct (FIG. 4 409) and the separation duct (FIG. 4 408) along with the relative position between the separation duct (FIG. 4 408) and the tubular duct (FIG. 4 401) can be arbitrarily moved along the main axis of the tubular duct (FIG. 4 401); wherein the separation duct (FIG. 4 408) can have an internal diameter comprised between 0.3 mm and 2.0 mm and is made of dielectric material and wherein the transport duct (FIG. 4 409) can have an internal diameter comprised between 0.1 mm and 1.0 mm and can be made of electrically insulating material or of conductive material;

The above-described example relative to a possible example of the device of the present invention allows obtaining surface engineering processes and surface activation treatments of long duration through processes of activation in plasma of the chemical precursors that flowed through the device and then the deposition of coatings that can be of organic or inorganic nature or nano-composites or organic-inorganic hybrids such as silicon, silica or siloxane-based coatings, acrylic acid-based coatings or other organic coatings or nano-composite coatings that contain nanoparticles immersed in an organic or inorganic or organic-inorganic hybrid matrix and in which the content of nanoparticles varies between 0.01 and 80% by volume and in which the thickness of the deposited coating can vary between 10 nm and 10.000 nm; wherein it is provided that the precursor flow is less than the transport gas flow, for the purpose of facilitating the movement of the precursor from the end of the transport duct (FIG. 4 409) or separation duct (FIG. 4 408) up to the surface of the substrate to be treated; wherein it is provided that the precursors that exit from the transport duct (FIG. 4 409) and from the separation duct (FIG. 4 408) react with the RF plasma at the outlet section of the transport duct (FIG. 4 409) or of the separation duct (FIG. 4 408).

Another example of the present invention allows flowing organic or metalorganic chemical precursors such as siloxanes, silazanes, transition metal alkoxides such as titanium isopropoxide, titanium tert-butoxide, zirconium isopropoxide and tert-butoxide, aluminum tert-butoxide, transition metal acetylacetonates such as titanium acetylacetonate, glycols like ethylene glycol, organic acids such as acrylic acid, methacrylic acid, acetic acid, organic acrylates, hydrocarbons or polyolefins, alcohols, aerosols of suspensions of nanoparticles dispersed in water or solvents where the nanoparticles can be metal oxides such as silicon oxides, titanium oxides, zirconium oxides, aluminum oxide, cerium oxide, chromium oxide or pure metals such as titanium, zirconium, silver, copper, gold, platinum, palladium, rare-earth metals or other transition metals; the abovementioned chemical precursors flow into a separation duct (FIG. 4 408) made of insulating material, in turn placed inside and coaxial with respect to the tubular duct (FIG. 4 401), with the free emission end placed inside said tubular duct in coinciding or retreated position with respect to the outlet section of said tubular duct; wherein the separation duct (FIG. 4 408) and the tubular duct (FIG. 4 401) are completely independent from each other and wherein the relative position between the separation duct (FIG. 4 408) and the tubular duct (FIG. 4 401) can be arbitrarily moved along the main axis of the tubular duct (FIG. 4 401); wherein the separation duct (FIG. 4 408) can have an internal diameter comprised between 0.3 mm and 2.0 mm;

The use of said transport duct (FIG. 4 409) for liquid precursors or precursor suspensions and of said separation duct (FIG. 4 408) for gases, vapors or aerosols—coaxial, internal, independent as flowed species and as control of the flow itself—allows separating the precursors from the gas flow in which the filamentary and RF plasma is generated, which flows into the annular cavity between the tubular duct (FIG. 4 401) and the separation duct (FIG. 4 408)

A further device provides for the use of a tubular duct with parallelepiped form (FIG. 5); wherein the electrodes (FIG. 5 503-504-505-506) in this example have rod-like form; wherein the internal size of the duct can vary in height between 1 and 100 mm (FIG. 5 510), in width from 1 to 10 mm (FIG. 5 509) and in length from 10 to 1000 mm (FIG. 5 508) with the electrodes positioned along the length; wherein the thickness of the walls of said tubular duct with parallelepiped form (FIG. 5 501), and obtained dielectric, can vary between 0.1 and 2 mm.

The device described in the present invention can be used for removing organic coatings such as Paraloid B67, Primal, Acryil 33, or paints with acrylic binder, alkyd binder, nitrocellulose binder, or paints with other binders and for the consequent cleaning of the surfaces.

The device described in the present invention can be used for depositing thin films with cross-linked siloxane base or inorganic coatings with titanium oxide base, zirconium oxide base, cerium oxide base or based on other oxides, or organic coatings based on acrylates, methacrylates and other polymers, or for depositing nanostructure coatings constituted by ceramic or metal nanoparticles immersed in organic matrices, inorganic matrices or hybrids in APVD (atmospheric plasma vapor deposition) and APLD (atmospheric plasma liquid deposition) mode.

The device described in the present invention can be used for obtaining removable surface coatings such as the EtA/MMA copolymer by means of a process defined full life protocol, which is of particular interest in the cultural heritage field.

The device described in the present invention can be used for obtaining treatments for the surface cleaning of metals such as silver, copper, alloys thereof such as bronzes, brasses or other metals and alloys in reducing atmosphere or adjuvants as erosive agents such as organic and inorganic acids or solvents.

The device described in the present invention can be used for obtaining treatments for surface activation, adhesion promotion and sterilization.

The device described in the present invention can be used for attaching, on the surface of the sample to be treated, specific chemical functionalities such as amine, carboxylic and others with particular functionalities in the promotion of cellular growth and in the biocompatibility of the surfaces.

DETAILED DESCRIPTION OF SOME PREFERRED EMBODIMENTS

Figure 1:
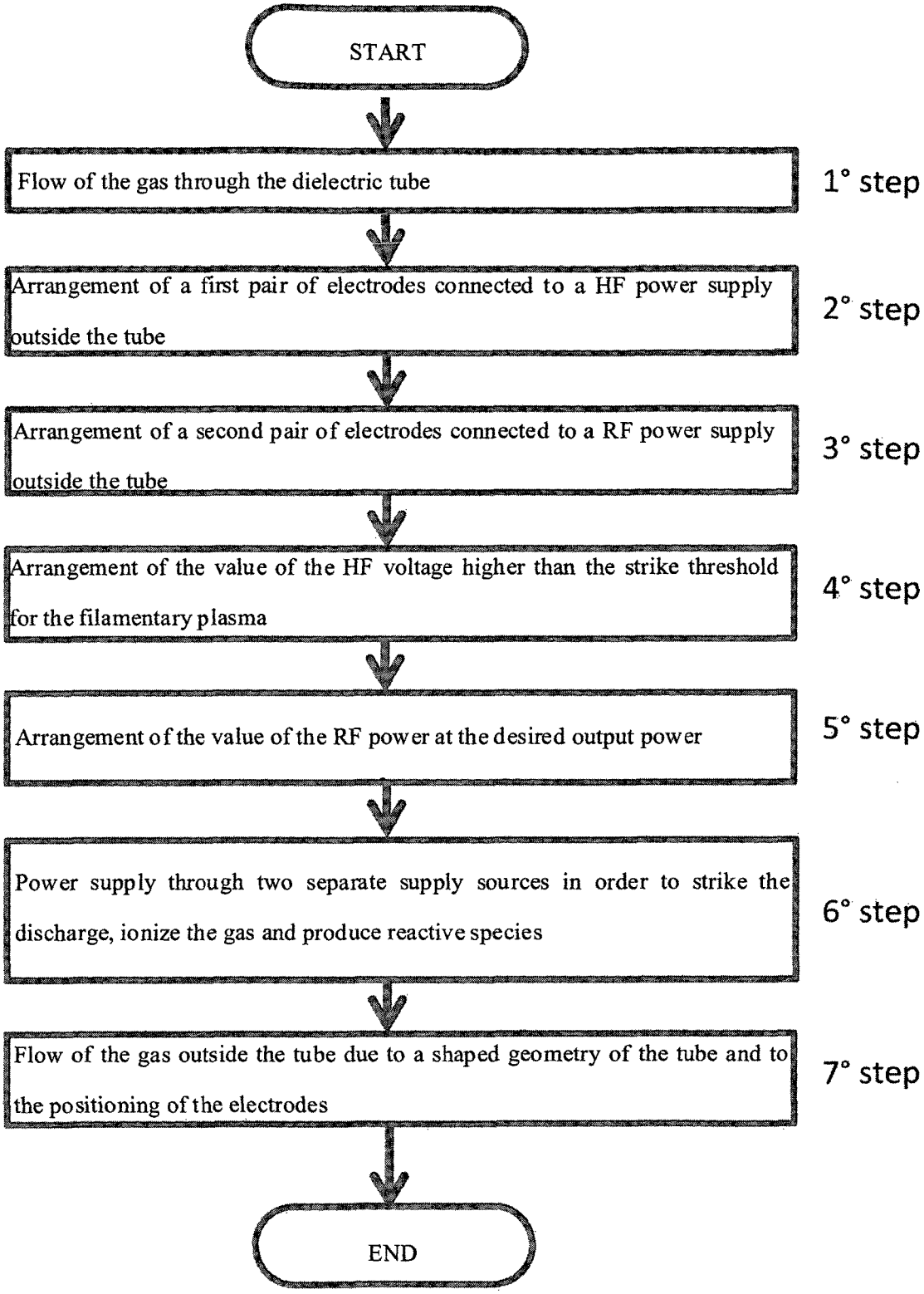
FIG. 1 is a block diagram that illustrates the mechanisms for generating the atmospheric plasma and the operation principle of the device in accordance with the present invention.

FIG. 1 illustrates a block diagram in which the different steps necessary for striking and sustaining the atmospheric plasma jet in accordance with the present invention are reported. The first step regards flowing the gas through said tubular duct made of dielectric material.

The aforesaid gas can be a monatomic noble gas (He, Ar, Ne, Kr) or a mixture thereof or a molecular gas (nitrogen, oxygen, carbon dioxide, hydrocarbons, water vapor, etc.) or mixtures of these, or a mixture of one or more monatomic gases with one or more molecular gases. Advantageously, the process gas, introduced into the tubular duct (201, 401, 501) through the inlet section thereof, comprises a mixture containing:

at least one noble gas, in particular selected from among He, Ar, Ne, Kr, and at least one reactive gas, selected in particular from among nitrogen, oxygen, carbon dioxide, hydrocarbons, sulfur hexafluoride, fluorocarbons, ammonia, etc.

The second regards positioning the first pair of coaxial electrodes connected to said high-frequency generator outside the tubular duct. The third step regards positioning said second pair of electrodes connected to the radio-frequency generator with said impedance adaptation circuit placed outside the tubular duct and in position downstream of the first pair of electrodes with respect to the flow of the gas in the tubular duct. Said impedance adaptation circuit of the Radio Frequency can be external or integrated inside the generator itself or integrated inside the body of the device. The fourth step regards setting the value of voltage applied by the high-frequency generator such to strike the filamentary plasma; for the correct operation of the device, it is not necessary to increase the voltage beyond the strike voltage. The high-frequency generator can also work with pulse trains, and in such case also the parameters of the pulse train must be set. The fifth step regards setting the value of power applied by the radio-frequency generator; such set value must be selected on the basis of the plasma density desired at the outlet of the outlet section of the tubular duct.

The sixth step regards turning on the generators and forming the filamentary plasma and the RF plasma and the formation of the reactive species.

The filamentary plasma and the RF plasma, which exit from the outlet section of the tubular duct (201, 401, 501), comprise at least one neutral gas at the outlet having temperature not higher than about 100° C.

Advantageously, during the generation of the second RF plasma, by the Radio-Frequency generator (209, 303), the high-frequency generator (208, 301) is substantially always operative for generating the aforesaid first filamentary plasma.

More in detail, preferably, the high-frequency generator (208, 301) is always maintained operative during the operation of the Radio-Frequency generator (209, 303), providing charged species that ensure the sustenance and extraction of the RF plasma even in the presence of process gases comprising mixtures of one or more noble gases with one or more reactive or transport gases.

The radio-frequency generator, in the case of use of pulse trains with the high-frequency generator, will only be active in said pulse trains.

Finally, the seventh step regards the exit of the gas from the duct and the flowing out of a jet or plume of plasma that can be used for surface activation purposes or for the deposition of surface coatings depending on the type of device employed.

Figure 2:
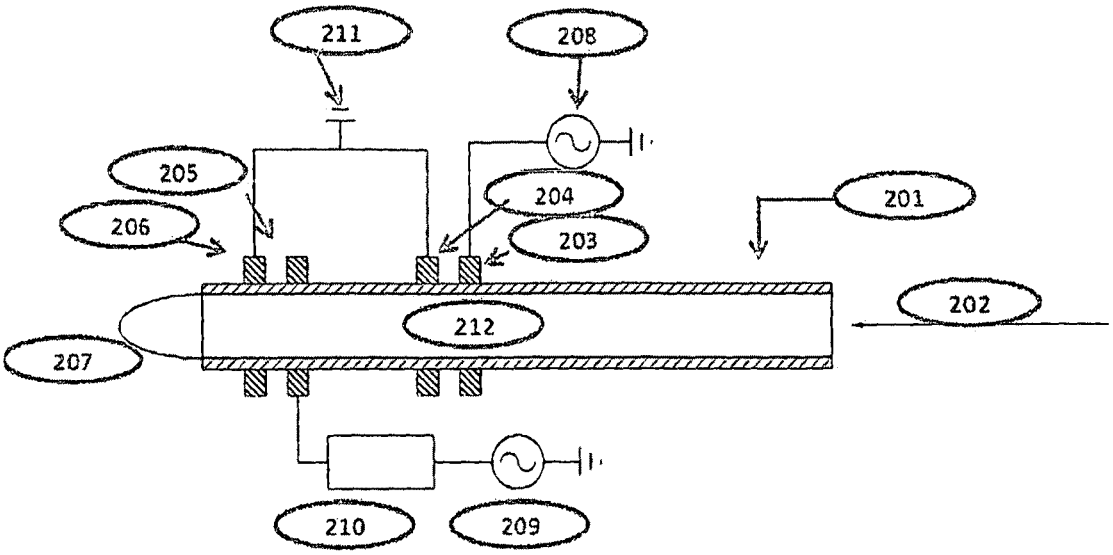
FIG. 2 is a schematic representation of the device for generating the atmospheric plasma jet with low temperature and low power in accordance with the present invention.
Figure 2:
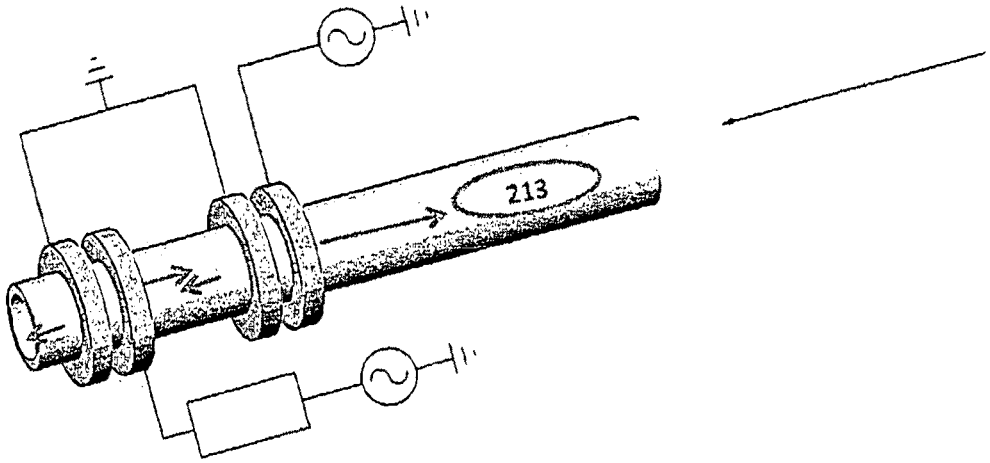

FIG. 2 illustrates a preferred device in accordance with the present invention; as in the preceding description, a tubular duct 201 is made of dielectric material and represents the body of the atmospheric plasma minitorch device; said dielectric material can be a ceramic material, glass and special glass, quartz or a polymer or composite material with high dielectric rigidity; a transport gas flows through the tube, 202.

Advantageously, as stated above, the device comprises a supply source connected to the inlet section of said tubular duct (201, 401, 501) and arranged for introducing, into the tubular duct (201, 401, 501), the process gas in the form of the aforesaid gas mixture. More in detail, preferably, the supply source comprises a gas cylinder or multiple gas cylinders (containing pure gases or gas mixtures) whose opening is regulated by valves. The cylinders are connected with the inlet section of the tubular duct (201, 401, 501) by means of a connector tube intercepted by a flow meter or another device that controls the inflow of the process gas, in the form of the gas mixture, into the tubular duct (201, 401, 501), for the regulation of the entering flow.

Advantageously, as stated above, the atmospheric plasma device comprises control means connected to the high-frequency generator (208, 301) and to the Radio-Frequency generator (209, 303) and arranged for controlling the high-frequency generator (208, 301) between a first non-operative state and a first operative state, and for controlling the radio-Frequency generator (209, 303) between a second non-operative state and a second operative state, in a manner such that, when the Radio-Frequency generator (209, 303) is controlled in its second operative state, the high-frequency generator (208, 301) is controlled in its first operative state, providing the charged species for the sustenance and extraction of the RF plasma.

For example, the aforesaid control means comprise a first switch interposed between the high-frequency generator (208, 301) and an electrical power source, and a second switch interposed between the radio-Frequency generator (209, 303) and the aforesaid electrical power source, such switches actuatable for connecting the corresponding generator to the electrical power source in order to enable the turning on thereof (and therefore determining the generation of the corresponding plasma).

In accordance with a particular embodiment, the aforesaid switches can be manually actuated, by means of corresponding buttons of the device.

Otherwise, the aforesaid switches are controlled in an automated manner by the aforesaid electronic control unit of the control means, which preferably comprises an electronic circuit board equipped with programmable CPU.

The two said pairs of coaxial electrodes, respectively 203 and 204, 205 and 206, are externally positioned with respect to said tubular duct; the electrodes are made of electrically conductive material and are typically metal; in the preferred device of the present invention, the electrode 203 is polarized by means of a high-frequency pulse generator (1-100 KHz), 208; the pulses can be in square or triangular wave form, or other wave forms; the electrode 205 is polarized by means of a Radio-Frequency generator, 209, which operates in the frequency range 1-30 MHz; the Radio-Frequency generator is equipped with said suitable circuit for the impedance adaption, 210, which can be integrated inside the generator itself or positioned on the body of the device; the electrodes 204 and 206 are grounded; the body of the device is also grounded; the gas which flows inside the body of the torch, passing through the region of space comprised between the electrodes, is ionized and consequently a plasma in DBD (Dielectric barrier Discharge) mode is struck, hence without providing for the presence of any electrode within the volume of said tubular duct and in particular the volume comprised between the electrodes; said ionized gas flows along the tubular duct, 212, and finally flows out of the duct as a jet or plume of plasma, 207; the positions of the electrodes can be varied along the main axis of the tubular duct according to the mode illustrated in 213, for the purpose of fine-controlling the mechanisms and the plasma generation mode and thus regulating the size and temperature of the plasma plume, 207; the two pairs of electrodes worked in a combined manner during the entire process and allow obtaining a plasma with low temperature, preserving high efficiency in the ionization; the use of the double frequency is beneficial to the extent in which it is able to combine the positive characteristics both of the high-frequency (HF) discharges and the Radio-Frequency discharges (RF); the RF torches tend in this sense to ensure greater plasma densities but with plasma jet of smaller size than that obtainable in HF, hence less effective and versatile from the application standpoint; on the other hand, the high voltages necessary for striking are much easier to obtain in HF than in RF; the combination of the two generators thus allows having stable ignitions, plasma jets of size comparable to those obtainable in HF but characterized by greater plasma densities and lower temperatures, as typically observed in the RF plasmas; the use of the high-frequency generator also allows increasing the extension of the plasma plume 207 beyond the tubular duct.

Figure 3:
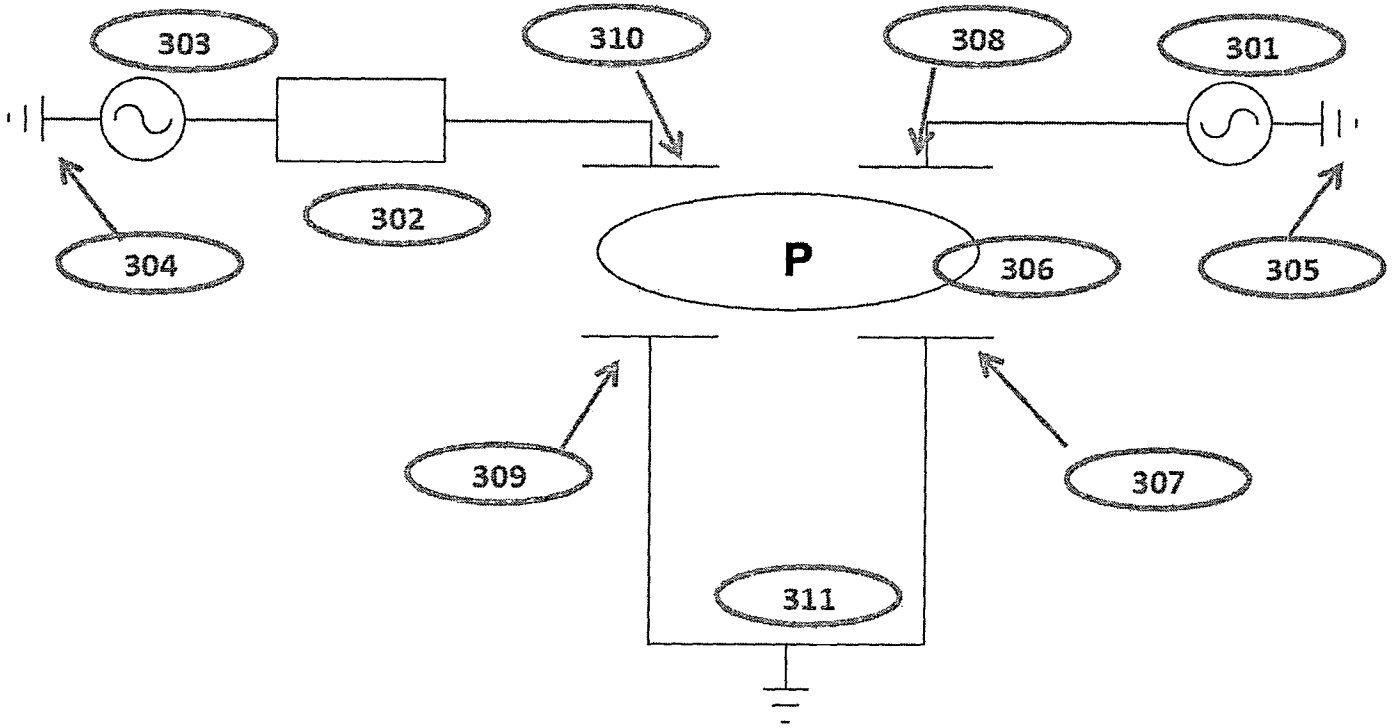
FIG. 3 is a circuit diagram that illustrates the mode of generating the atmospheric plasma in accordance with the present invention comprising the connections and the general electrical layout of the device.

FIG. 3 reports a circuit diagram of said system constituted by 2 pairs of coaxial electrodes. In the preferred device in accordance with the present invention, said first pair of electrodes, 307 and 308, is connected to said high-frequency generator employed in pulsed mode, 301. The generator in the preferred device operates at a frequency of 28 KHz and a peak voltage of 15 Kvolts; nevertheless, in future devices, the frequencies employed can be comprised in the range 1-100 KHz with peak voltages up to 40 KVolts. The preferred pulsation in the device is obtained with a frequency of 500 Hz and a useful work cycle of 80%; nevertheless, in future devices the frequency can be varied from 50 to 800 Hz and the useful work cycle in the range between 10 and 98%. Said second pair of electrodes, 309 and 310, is connected to said generator RF, 302, and the impedance of the circuit is adapted due to said adaptation circuit, 303. The frequency in the preferred device is 13.56 MHz, though in future devices it can be comprised in a range between 1 and 30 MHz. The two generators are coupled due to the coupling of the pulse of the high-frequency generator with the signal at Radio Frequency or vice versa in order to ensure a positive phase coupling between the two signals. In addition, once the plasma has been struck, 306, the separation distance between the two pairs of electrodes is suitably set in order to ensure the coexistence of the two discharges within the same plasma region, leading to the obtainment of a plasma combined in double-frequency. Both generators are grounded, 304 and 305, just as the counter-electrodes of each pair, 307 and 309, are grounded in a distinct and separate manner, respectively for the HF and RF generators.

Figure 4:
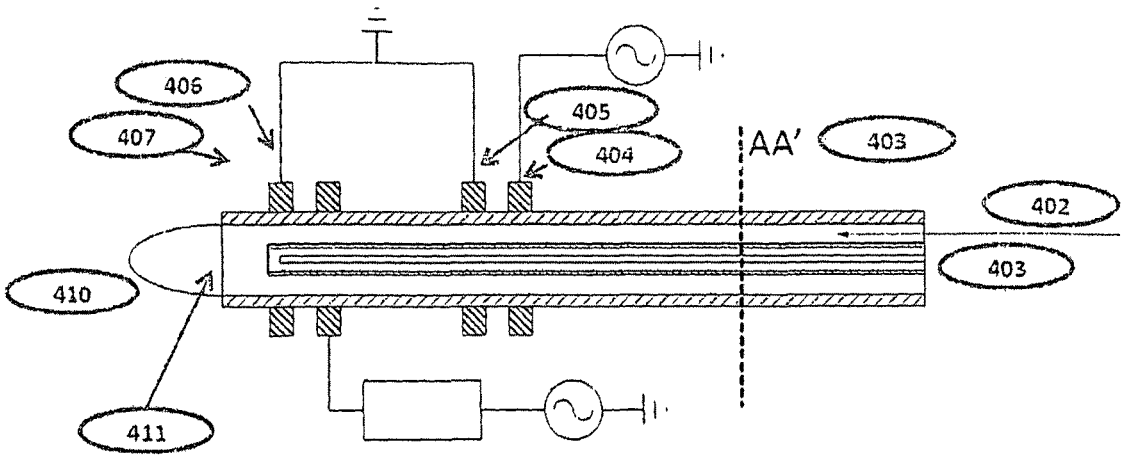
FIG. 4 is a schematic representation of the device for generating said atmospheric plasma jet with low power and low temperature in which said tubular transport and separation ducts for allowing the deposition are also reported.
Figure 4:
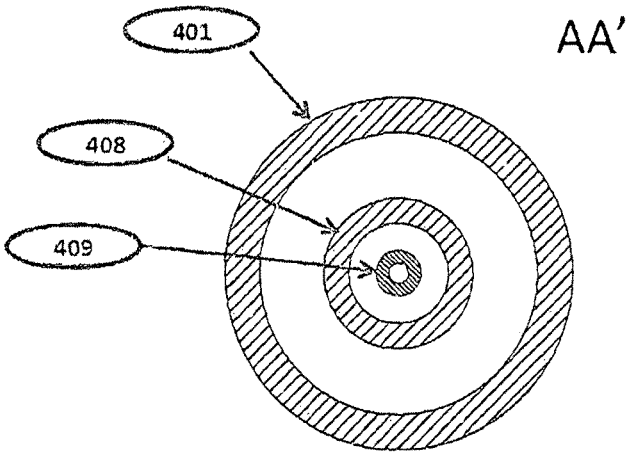

FIG. 4 shows an example of the device in accordance with the present invention equipped with a configuration specifically ideated for the deposition of coatings and hereinbelow termed coaxial nebulizer. The distribution and consequent flow of the precursor, as described in the present invention, is coaxial with respect to the flow of process gas. Within the tubular duct, made of dielectric material, 401, a transport duct, 409, is inserted with a separation duct made of electrically insulating material, 408, interposed between the tubular duct and the transport duct. The process gas is flowed as in the previously-described device starting from the bottom, 402, before then passing through the annular duct comprised between the separation duct, 408, and the tubular duct and made of dielectric material, 401. The role of the separation duct is also that of preventing the transport duct, 409, from being exposed to the plasma. In addition, a liquid precursor or precursor in suspension form can be flowed into the transport duct, 409, while a second gas or precursor in vapor or aerosol form can be flowed into the annular cavity comprised between the internal surface of the separation duct, 408, and the external surface of the transport duct, 409; in case of flowing a fluid precursor or suspension into the transport duct, and a gas into the annular cavity between the transport duct and the separation duct, at the outlet of the ducts the two flows reach in contact with the formation of a dispersion or aerosol. Further devices can implement more than 1 transport duct within the separation duct in order to allow the individual and separate inflow of multiple precursors in different zones of the plasma, thus fine-controlling the process chemistry. The four electrodes belonging to the two said pairs of coaxial electrodes, 404, 405, 406 and 407 are positioned as in the case of the preferred device. The precursor flowing mode occurs starting from the bottom, 403, through the transport duct up to the terminal part of the device. The final position of the transport duct, 411, can be moved along the main axis of the device in order to regulate the length and thus the contact time between the precursor and the plasma. This particular device allows finely regulating the entrance position of the precursor in the plasma zone and hence controlling the chemical reactivity of the precursor, the density and type of the radical and chemically active species produced and which constitute the plasma plume projected on the surface to be treated, 410. The chemical precursors that can be used in this device include organic precursors, metalorganic precursors and suspensions containing nanoparticles of any nature and species. The transport duct can have internal diameters comprised between 0.1 mm and 1.0 mm while the separation duct can have internal diameters comprised between 0.3 and 2.0 mm and in any case necessarily larger than the external diameter of the transport duct. The thickness of the transport duct can also vary and is typically comprised between 0.1 mm and 0.3 mm while the thickness of the separation duct is typically comprised between 0.4 and 1.0 mm.

Figure 5:
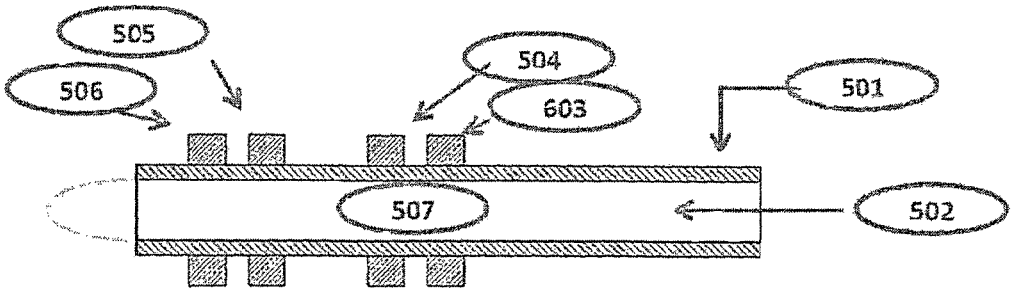
FIG. 5 is a schematic representation of the device for generating said atmospheric plasma jet in accordance with the present invention which implements the use of said tubular duct with parallelepiped form.
Figure 5:
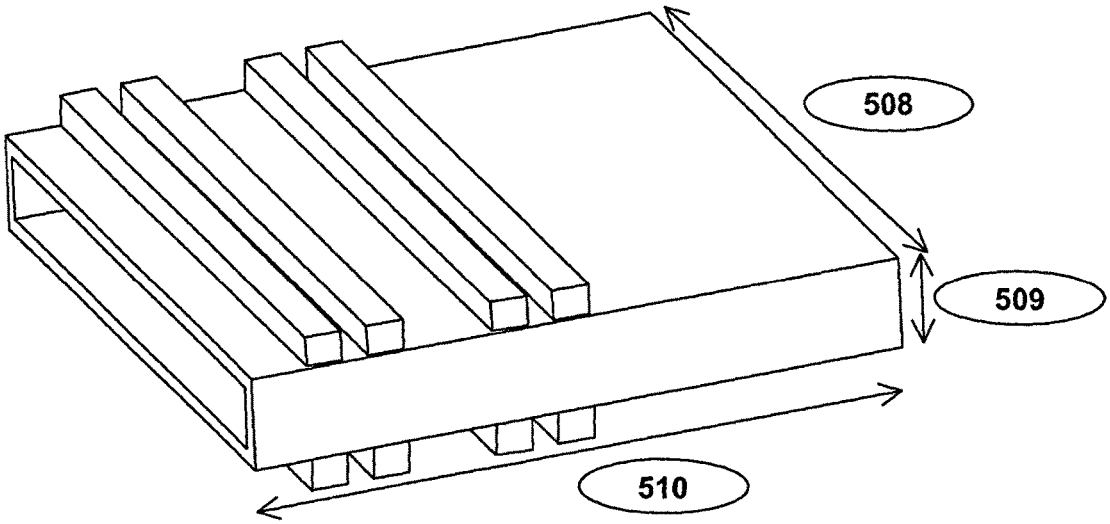

FIG. 5 shows an example of the device in accordance with the present invention provided with a tubular duct with parallelepiped form and made of dielectric material, 501, which represents the body of the atmospheric plasma device; the dielectric material can be ceramic, glass, quartz or a polymer or composite material with dielectric characteristics; the transport gas flows through said tubular duct, 502, and can be a monatomic noble gas such as He, Ar, Ne or a molecular gas such as nitrogen, oxygen, hydrogen, carbon dioxide, methane or other hydrocarbons, water vapor or any mixture of monatomic, diatomic gases, or mixed monatomic and molecular gases; two said pairs of electrodes, with rod-like form, respectively 503 and 504, 505 and 506 are positioned outside the body of the device; the electrodes are made of conductive material and are typically metallic, 503 is polarized by a high-frequency generator (1-100 kHz) and used in pulsed mode; the pulses can have square or triangular wave form or other wave forms; 505 is polarized at radio frequency by means of a generator that operates in the range 1-30 MHz; the electrodes 504 and 506 are grounded; the body of the device is also grounded; the plasma is generated within the tubular duct and a plasma blade flows out from the end of the body of the device, 507; the size of the body of the device with parallelepiped form 508, 509 and 510, i.e. respectively the length, width and height, can be comprised between 10 and 1000 mm and the aspect ratio of the device defined as the ratio between the height and width of the device can vary between 1 (device with square section) and 100 (device with sheet-like plasma).

Example 1

Removal and Erosion of Polymer Coatings and Organic/Inorganic Hybrids

A first example of practical use of the present invention, in accordance with the device represented in FIG. 2, is its use in the removal of some polymer products like acrylic products and epoxy resins. Acrylic products such as Paraloid B72 and the like (Paraloid B67, Primal, Acryil 33, etc.), typically used as transparent protections for handmade items of cultural heritage interest, must be removed and replaced after a certain period of exposure to weathering agents. For such use, a mixture of Argon containing 0.3% Oxygen is used as ionizing gas; it is flowed at a velocity of 10 L/min and introduced by means of the tubular duct, 401. The two pairs of electrodes, that at high frequency and that at radio frequency, are made to work at a power of 15 W and 90 W, respectively, in direct or pulsed mode, at a frequency of 30 kHz and 27 MHz. By placing the material to be treated with the polymer coating to be removed at a distance of 2 mm, a removal velocity of 20 μm/min was obtained for Paralod B72. The maximum temperature of the device does not exceed 40° C., even for continuous treatments of 600 s, and makes possible the manual use of the device by an operator. Also the temperature on the surface of the treated materials is maintained below 50° C., thus allowing the use of the device for treating, sensitive materials. The plasma conditions are very stable and no electric arc generation phenomenon was observed during such experiments. The present invention is thus advantageous in the safe and controllable removal of protective polymer coatings applied to handmade items of historical-cultural interest, allowing the restorer to operate manually, directly controlling the advancement of the desired cleaning process.

In addition to the polymer coatings employed as protections, the present invention allows assisting the cleaning and removal of graffiti and spray paints typically used by the "writers" to sully urban decoration pieces and objects of historical-cultural interest. For this type of application, the power applied to the pair of RF electrodes is 160 W in pulsed conditions. After a treatment of 120 s, the polymer binder of the paint (acrylic, alkyd, nitrocellulose, etc.) is visibly removed, and the organic pigments lose cohesion, becoming easily removable by means of operation with moist cloth. By repeating such procedure multiple times, the graffiti is completely removed. Alternatively, the device, object of the present invention, has been successfully used following a cleaning operation conducted with solvent; the residues of the polymer paints, which after having been dissolved by the solvent tend to penetrate into the pores of the substrate, were successfully removed by the cold plasma produced by an exemplar of the present invention, by applying the above-described parameters.

It is observed that the use of the proposed method and device is not limited to the removal of only acrylic polymers, but generally it can be extended to the removal and erosion of all polymer materials and all organic/inorganic hybrid materials containing a polymer fraction. In addition, by using the torch exemplar in the above-described conditions, the complete cleaning and removal of the soot from stone surfaces is obtained; a few minutes of precise treatment are sufficient for completely removing the soot from a surface area of about 1 $cm^2$.

Example 2

Deposition of Thin Organic, Inorganic and Hybrid Films

The exemplar of the present invention, equipped with the coaxial nebulizer in accordance with the device, object of the present invention, and represented in FIG. 4, was employed in the deposition of thin silica films. The liquid precursor, hexamethyldisiloxane (other precursors with organo-silicate base can alternatively be employed), is introduced into the transport duct, 409, at a velocity of 0.1 mL/min, and nebulized due to a flow of air or Argon or Argon/Oxygen, blown inside the separation duct, 408, at 5 L/min. Through the main tubular duct, the ionizing gas (Argon, or Argon containing 0.3% Oxygen, at 10 L/min) is instead made to flow, which in addition to generating the plasma allows the chemical precursor to polymerize and produce the thin film. By applying a power of 20 W to the low-frequency generator, and a power of 50 W to the radio-frequency generator, a silica film with 1 μm thickness is obtained, for a sample placed at 2 mm distance from the outlet, and for a precise treatment of 10 s duration. The exemplar of the present invention is therefore able to deposit in APLD (atmospheric plasma liquid deposition) mode.

The exemplar of the present invention (as represented in FIG. 4), can deposit thin silica films, introducing in the plasma the vapors of the selected chemical precursor (hexamethyldisiloxane, tetraethoxysilane, or other silica-based precursors), working in APVD (atmospheric plasma vapor deposition) mode. The gas carrier (Argon or Argon/Oxygen) is made to flow, at 0.25 L/min, inside the recipient containing the liquid chemical precursor in a manner such to capture the volatile fraction of the chemical precursor itself and carry it into the plasma by using the separation duct, 408. By applying the conditions described in the preceding paragraph, a silica film with 400 nm thickness is obtained, which indicates a deposition efficiency of 40 nm/s.

The above-described two deposition modes (APLD, APVD) were also employed for the deposition of polymer films such as, but not limited to, polymethylmethacrylate (PMMA). By operating in the above-described APVD conditions, a deposition efficiency of the PMMA is obtained that is equal to 60 nm/s. In general, the higher the vapor tension of the starting monomer, the greater the efficiency will be in the deposition of the corresponding polymer.

Due to the multi-coaxiality of the exemplar of the present invention (as represented in FIG. 4), the deposition system allows the creation of coatings with organic/inorganic hybrid character. A dispersion containing nanoparticles (ceramic, polymer, metallic, hybrid), but not limited to nanoparticles, is introduced through the transport duct, 409, and nebulized due to a flow of Argon or Argon/Oxygen that has previously passed through the vapors of a chemical precursor, such as hexamethyldisiloxane (but not limited to the latter), and that is introduced through the separation duct, 408. In this manner, at the outlet of the nozzle, the precursor polymerization reaction takes place, which leads to the deposition of a thin film which will incorporate the nanoparticles exiting from the transport duct.

It is observed that the use of the method and exemplar of the present invention is not limited to the deposition of silica films, but in general can be extended to the deposition of: zirconium oxide, titanium oxide, aluminum oxide, cerium oxide. Analogously the deposition of polymer films is not limited to PMMA, but generally can be extended to all polymers whose starting monomers are available in solution.

Example 3

Application of a New Cultural Heritage Protocol

By means of the use of an exemplar of the present invention (as represented in FIG. 4), it was possible to create a new protocol for the deposition of protective polymer films and for their possible controlled removal, to be used in the scope of cultural heritage conservation. By exploiting the multi-coaxiality of an exemplar of the present invention, a first gas carrier constituted by Argon or Argon/Oxygen is made to flow into a recipient containing methyl-methacrylate monomer (MMA) in a manner so as to capture the vapors, and introduced into the separation duct, 408. A second gas carrier, still constituted by Argon or Argon/Oxygen, is instead flowed into a second recipient containing ethyl-acrylate monomer (EtA), in order to then be introduced into the transport duct, 409. In this manner, as suggested by Totolin et al. (described in Totolin et al. Journal of Cultural Heritage 12 (2011) 392 and enclosed herein for reference), a copolymerization in plasma is obtained that leads to the formation of the analogous commercial product Primal AC33 (Rohm and Haas), widely used in the field. The polymer film is deposited on a silicon substrate, and after having aged the polymer due to the action of a UV lamp (aging time=500 h), it was removed by means of plasma, obtaining a removal velocity comparable to that obtained in the removal of the Paraloid B72.

Example 4

Reducing Treatments: Cleaning of Metal Oxides and Sulfides

The device of the present invention (as represented in FIG. 2) can also be employed in the reducing cleaning of metal oxides and sulfides. For this application, the best results are obtained by using a mixture of Argon with 2% Hydrogen as ionizing gas; the power applied to the two pairs of electrodes was 15 W and 80 W, respectively for the two high-frequency and radio-frequency generators, while the nozzle-sample distance, for this treatment type, was brought to 5 mm in a manner so as to be able to work with the device in After glow conditions, i.e. the conditions in which the material to be treated is placed outside the beam produced by the plasma, and not in direct contact therewith. In these conditions, with a precise treatment of 2 minutes, the total removal of the silver sulfide from a sample of Ag999 and Ag925 aged naturally is obtained. It is observed that also for this treatment type, the temperature measured at the substrate never exceeded 25° C.; the use of the present invention has therefore proven to be extremely effective even for the specific treatment of thermosensitive materials.

Due to the use of an exemplar of the present invention, (as represented in FIG. 4), it is possible to assist the cleaning of metals, by nebulizing solutions with reducing behavior in the plasma. A diluted HCl solution (0.1M) is introduced into the transport duct, 409, while a flow of Argon is introduced into the separation duct, 408, in order to nebulize the solution at the outlet of the plasma. In these conditions, with a precise treatment of 2 minutes, the total removal of the copper sulfide from sample of naturally-aged Cu999 was obtained.

Example 5

Surface Cleaning, Sterilization and Activation

A further example of use of the present invention (as represented in FIG. 2) is the more common surface activation and cleaning. The plasma produced by the different exemplars proposed is able to increase the wettability of the treated surfaces, facilitating the processes of overprinting and adhesion. A polymer material such as polystyrene or polypropylene can increase its surface energy from 34-36 mN/m to 70-72 mN/m. Correspondingly, the contact angle values of the water pass from 80-100° for non-treated materials to 10-15° for the materials treated in the following conditions used in example 1. The effectiveness of the cleaning action is also given by the capacity of the produced plasma to degrade possible organic substances, oils and fats possibly present on the surface of interest, and in the case of polymer materials is also given by the effect of the controlled mild erosion of the polymer itself, which is renewed on the surface.

The surface cleaning action produced by the plasma generated by the present invention can also be exploited in surface sterilization processes, and in processes for removing bacteria and other dangerous biological organisms. The effect of the sterilization action can also be increased by means of the use of the exemplar in accordance with the present invention (as represented in FIG. 4) and in particular by introducing into the plasma, by means of the transport duct, 409, reagents such as water vapor, which lead to the formation of peroxide ions useful for such purpose.

Example 6

Attachment of Surface Chemical Functionalities

If the simple surface activation and cleaning does not suffice for solving some problems tied to the adhesion between different materials, an exemplar of the present invention can be used for attaching, on the surfaces of interest, several chemical functionalities suitably selected and useful for the adhesion between dissimilar materials. By using an exemplar in accordance with the present invention (as represented in FIG. 4), in the operative conditions described in example 2, and introducing by means of the separation duct 408 organic monomer vapors containing chemical functionalities such as: acrylic groups, epoxy groups, amines (but not limited to these), the adhesions between materials that use epoxy joints, urethane joints and acrylic joints have significantly improved. This type of surface functionalization has also allowed designing processes capable of substituting the application of the solvent-based primers, with the surface deposition of the abovementioned chemical functionalities.

Analogous to that described in the preceding point, by using chemical precursors such as allylamine, acrylic acid or the like, it is possible to fix, on the surface of the treated materials, functionalities of amine and/or carboxylic type that are useful for biomedical materials or for materials in which it is desired to boost and accelerate cellular growth.

The invention claimed is:

1. Method for generating an atmospheric plasma jet which comprises:

flowing a process gas that advances in a flow direction (202, 402, 502) through a tubular duct (201, 401, 501) made of dielectric material with an inlet section and an outlet section (207, 410) at atmospheric pressure;

positioning a first pair of coaxial electrodes (203-204, 307-308, 404-405, 503-504) and a second pair of coaxial electrodes (205-206, 309-310, 406-407, 505-506) in contact with the external surface of said tubular duet (201, 401, 501); said first pair of electrodes (203-204, 307-308, 404-405, 503-504) being placed in position upstream of said second pair of electrodes (205-206, 309-310, 406-407, 505-506) in relation to the flow direction of said process gas in said tubular duct (202, 402, 502) and being connected to a high-frequency generator (208, 301); said second pair of electrodes (205-206, 309-310, 406-407, 505-506) being connected to a Radio-Frequency generator (209, 303);

said high-frequency generator (208, 301) generating a filamentary plasma within said tubular duct (201, 401, 501), said filamentary plasma extending at least to said second pair of electrodes (205-206, 309-310, 406-407, 505-506);

said Radio-Frequency generator (209, 303) generating a second RF plasma;

flowing out said RF plasma and said filamentary plasma to outside the tubular duct (201, 401, 501) through said outlet section (207, 410), such plasmas at the outlet comprising at least one neutral gas at the outlet having temperature not higher than about 100° C.

2. Method according to claim 1, wherein during the generation of said RF plasma, by said Radio-Frequency generator (209, 303), said high-frequency generator (208, 301) is substantially always operative for generating said filamentary plasma.

3. Method according to claim 1, wherein the process gas, introduced into said tubular duct (201, 401, 501) through the inlet section thereof, comprises at least one from among the following substances: helium, hydrogen, oxygen, nitrogen, argon, air, neon, carbon oxide, hydrocarbons.

4. Method according to claim 3, wherein the process gas, introduced into said tubular duct (201, 401, 501) through the inlet section thereof, comprises a mixture containing at least one noble gas and at least one reactive gas.

5. Method according to claim 1, wherein the high-frequency generator (208, 301) generates pulse trains and the Radio-Frequency generator (209, 303) is substantially exclusively active in said pulse trains.

6. Method according to claim 5, wherein the Radio-Frequency generator (209, 303) operates in the frequency range comprised between 1 and 30 MHz.

7. Method according to claim 5, wherein the pulsed high-frequency generator (208, 301) operates in the frequency range comprised between 1 and 100 kHz; wherein the pulse duration is up to 20 ms with a duty cycle in the range comprised between 10 and 98%.

8. Atmospheric plasma minitorch device characterized in that it comprises:

a tubular duct (201, 401, 501) made of dielectric material with an inlet section and an outlet section (207, 410) at atmospheric pressure;

at least one supply source connected to the inlet section of said tubular duct (201, 401, 501) and arranged for introducing said process gas into said tubular duct (201, 401, 501);

a first pair of coaxial electrodes (203-204, 307-308, 404-405, 503-504) and a second pair of coaxial electrodes (205-206, 309-310, 406-407, 505-506) in contact with the external surface of said tubular duct (201, 401, 501); said first pair of electrodes (203-204, 307-308, 404-405, 503-504) being placed in position upstream of said second pair of electrodes (205-206, 309-310, 406-407, 505-606) in relation to the flow direction of said process gas in said tubular duct (202, 402, 502) and being connected to a high-frequency generator (208, 301); said second pair of electrodes (205-206, 309-310, 406-407, 505-506) being connected to a Radio-Frequency generator;

said high-frequency generator (208, 301) being arranged for generating a filamentary plasma within said tubular duct (201, 401, 501), said filamentary plasma extending at least to said second pair of electrodes (205-206, 309-310, 406-407, 505-506) and exiting from said tubular duct (201, 401, 501) through said outlet section;

said Radio-Frequency generator (209, 303) being arranged for generating a RF plasma which exits from said tubular duct (201, 401, 501) through said outlet section (207, 410);

said filamentary plasma and said RF plasma exiting from said tubular duct (201, 401, 501) comprising at least one neutral gas at the outlet having temperature not higher than about 100° C.

9. Atmospheric plasma minitorch device according to claim 8, characterized in that it comprises control means connected to said high-frequency generator (208, 301) and to said Radio-Frequency generator (209, 303) and arranged for controlling said high-frequency generator (208, 301) between a first non-operative state and a first operative state, in which said high-frequency generator (208, 301) generates said filamentary plasma; said control means being arranged for controlling said Radio-Frequency generator (209, 303) between a second non-operative state and a second operative state, in which said Radio-Frequency generator (209, 303) generates said RF plasma with said high-frequency generator (208, 301) in said first operative state.

10. Atmospheric plasma minitorch device according to claim 9, characterized in that said control means comprise at least one electronic control unit connected to said high-frequency generator (208, 301) and to said Radio-Frequency generator (209, 303), and programmed for controlling the activation of said Radio-Frequency generator (209, 303), controlled in said second operative state, during pulse trains generated by the high-frequency generator (208, 301) controlled in said first operative state.

11. Atmospheric plasma minitorch device according to claim 8, characterized in that it comprises at least one supply source connected to the inlet section of said tubular duct (201, 401, 501) and arranged for introducing said process gas into said tubular duct (201, 401, 501), which can be modulated both with regard to the entering flow and the composition, in mixture form containing at least one noble gas and at least one reactive gas.

12. Atmospheric plasma minitorch device according to claim 8, wherein the tubular duct (201) has circular section and is made of dielectric material such as glass, ceramic, polymer, composite or other dielectric material and wherein the external diameter of the tubular duct is comprised between 1 mm and 15 mm.

13. Atmospheric plasma minitorch device according to claim 8, wherein the body of the device is a tubular duct with rectangular section (501) and wherein the shorter side is comprised between 1 mm and 15 mm (509).

14. Atmospheric plasma minitorch device according to claim 8, wherein the high-frequency generator (208) operates in the range comprised between 1 and 100 kHz and wherein the duration of the pulse is comprised in the range between 1.25 and 20 ms with a duty cycle in the range comprised between 10 and 98%; wherein the Radio Frequency generator (209) operates in the range comprised between 1 and 30 MHz; and wherein the activation of said radio-frequency generator (209) is susceptible of being controlled by said pulse trains generated by the high-frequency generator.

15. Atmospheric plasma minitorch device according to claim 8, which also comprises:

a transport duct (409), through which a liquid precursor or a precursor in the form of a particle suspension in a liquid can be flowed, such duct (409) positioned inside and coaxial with respect to the tubular duct (401), with the free emission end placed inside said tubular duct at a distal position from the outlet section of said tubular duct (401).

16. Atmospheric plasma mini torch device according to claim 15, which also comprises:

a separation duct (408) made of dielectric material with larger internal diameter with respect to the transport duct (409) and with smaller external diameter with respect to the tubular duct (401), coaxially interposed between said transport duct (409) and said tubular duct (401), and it too equipped with an outlet section;

an annular cavity being defined by the external surface of the transport duct (409) and by the internal surface of said separation duct (408), into which a nebulizer gas flows which, by intercepting the fluid exiting from the transport duct (409), generates an aerosol at the free emission end of said transport duct (409).

17. Atmospheric plasma minitorch device according to claim 15, which also comprises:

a separation duct (408) made of dielectric material with larger internal diameter with respect to the transport duct (409) and with smaller external diameter with respect to the tubular duct (401), coaxially interposed between said tubular duct (401) and said transport duct (409);

an annular cavity being defined by the external surface of the transport duct (409) and by the internal surface of said separation duct (408), into which a process has flows in the form of vapors or aerosols of chemical precursors, such process gas interacting with the RF plasma at the outlet section.

* * * * *